US011946366B2

(12) United States Patent
Ismailova et al.

(10) Patent No.: US 11,946,366 B2
(45) Date of Patent: Apr. 2, 2024

(54) SYSTEM AND METHOD FOR FORMATION PROPERTIES PREDICTION IN NEAR-REAL TIME

(71) Applicant: SAUDI ARABIAN OIL COMPANY, Dhahran (SA)

(72) Inventors: Leyla Ismailova, Moscow (RU); Sergey Safonov, Moscow (RU); Egor Tirikov, Moscow (RU); Mokhles Mezghani, Dhahran (SA); Mustafa Al Ibrahim, Safwa (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 480 days.

(21) Appl. No.: 17/173,145

(22) Filed: Feb. 10, 2021

(65) Prior Publication Data

US 2022/0251951 A1 Aug. 11, 2022

(51) Int. Cl.
*E21B 49/00* (2006.01)

(52) U.S. Cl.
CPC ..... *E21B 49/003* (2013.01); *E21B 49/005* (2013.01); *E21B 2200/20* (2020.05); *E21B 2200/22* (2020.05)

(58) Field of Classification Search
CPC .. E21B 49/003; E21B 49/005; E21B 2200/20; E21B 2200/22; E21B 41/00
See application file for complete search history.

(56) References Cited

U.S. PATENT DOCUMENTS 7,079,952 B2 7/2006 Thomas et al.
8,705,318 B2 4/2014 Zheng et al.
(Continued)

FOREIGN PATENT DOCUMENTS

| | | | | | |
|---|---|---|---|---|---|
| CA | 2794094 | C | | 2/2020 | |
| GB | 2552939 | A | * | 2/2018 | ..... E21B 44/00 |
| GB | 2552939 | A | | 2/2018 | |
| WO | 2008094944 | A1 | | 8/2008 | |
| WO | 2013089683 | A1 | | 6/2013 | |
| WO | 2016077521 | A1 | | 5/2016 | |
| WO | 2016154723 | A1 | | 10/2016 | |

OTHER PUBLICATIONS

Gupta et al. "Looking Ahead of the Bit Using Surface Drilling and Petrophysical Data: Machine-Learning-Based Real-Time Geosteering in Volve Field", 2020 (Year: 2020).*
(Continued)

*Primary Examiner* — Rehana Perveen
*Assistant Examiner* — Troy A Maust
(74) *Attorney, Agent, or Firm* — Osha Bergman Watanabe & Burton LLP

(57) ABSTRACT

A method for formation properties prediction in near-real time may include obtaining lab measurements of existing drill cuttings at a plurality of depths of a first well. The method may include obtaining historical drilling surface data at the plurality of depths from a plurality of wells. The method may include obtaining real-time digital photos and real-time drilling surface data of new drill cuttings at a new depth of a new well. The method may include generating, using a prediction model, predicted formation properties of the new drill cuttings based on the real-time digital photos, the real-time drilling surface data, and the new depth. The method may include predicting, using a near-real-time model and the predicted formation properties, near-real-time formation properties in the new well, wherein the prediction model comprises a historical model that employs a machine-learning algorithm.

15 Claims, 5 Drawing Sheets

(56) References Cited

U.S. PATENT DOCUMENTS

| | | | | |
|---|---|---|---|---|
| 9,016,399 | B2 | 4/2015 | Pelletier et al. | |
| 2004/0256152 | A1 | 12/2004 | Dashevskiy et al. | |
| 2014/0351183 | A1* | 11/2014 | Germain | E21B 44/00 706/12 |
| 2015/0241591 | A1* | 8/2015 | Burmester | G01V 11/00 702/7 |
| 2017/0058620 | A1 | 3/2017 | Torrione | |
| 2019/0147125 | A1* | 5/2019 | Yu | E21B 49/003 703/10 |
| 2020/0040719 | A1* | 2/2020 | Maniar | E21B 41/00 |
| 2021/0319257 | A1* | 10/2021 | Francois | G06V 10/774 |
| 2022/0107279 | A1* | 4/2022 | Krumm | E21B 49/00 |
| 2022/0120168 | A1* | 4/2022 | Katterbauer | H04N 5/30 |

OTHER PUBLICATIONS

International Search Report and Written Opinion issued in Application No. PCT/US2022/015982, dated Apr. 7, 2022 (13 pages).

* cited by examiner

SYSTEM AND METHOD FOR FORMATION PROPERTIES PREDICTION IN NEAR-REAL TIME

BACKGROUND

Drill cuttings are an important source of information that is directly available at a well site. Mineralogy and lithology properties of the formation being drilled can be determined through laboratory measurements of the drill cuttings. During drilling, the drilling fluid constantly circulates and enters a shaker, bringing with it pieces of the formation. Further, laboratory measurements make it possible to determine the composition and physical and chemical properties of the formation that is currently being drilled. Upon knowing these formation properties, geologists and engineers can make effective decisions on hydrocarbon drilling and production, and further accurately pick casing points, formation tops, and perforation zones. Current procedures for formation properties determinations are heavily dependent on time-consuming laboratory measurements and a geologist's experience, and thus, may involve time delays and be subject to human error.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for formation properties prediction in near-real time. The method includes obtaining, by a computer processor, lab measurements of existing drill cuttings at a plurality of depths of a first well. The method includes obtaining, by the computer processor, historical drilling surface data at the plurality of depths from a plurality of wells. The method includes obtaining, by the computer processor, real-time digital photos and real-time drilling surface data of new drill cuttings at a new depth of a new well. The method includes generating, by the computer processor using a prediction model, predicted formation properties of the new drill cuttings based on the real-time digital photos, the real-time drilling surface data, and the new depth. The method further includes predicting, by the computer processor using a near-real-time model and the predicted formation properties, near-real-time formation properties in the new well, wherein the prediction model comprises a historical model that correlates the lab measurements of the existing drill cuttings, and the historical drilling surface data from the plurality of wells, by employing a machine-learning and deep learning algorithms.

According to one aspect, embodiments disclosed herein relate to a system for formation properties prediction in near-real time. The system includes a plurality of formation properties data and a formation properties manager comprising a computer processor. The formation properties manager obtains lab measurements of existing drill cuttings at a plurality of depths of a first well. The formation properties manager obtains historical drilling surface data at the plurality of depths from a plurality of wells. The formation properties manager obtains real-time digital photos and real-time drilling surface data of new drill cuttings at a new depth of a new well. The formation properties manager generates, using a prediction model, predicted formation properties of the new drill cuttings based on the real-time digital photos, the real-time drilling surface data, and the new depth. The formation properties manager further predicts, using a near-real-time model and the predicted formation properties, near-real-time formation properties in the new well, wherein the prediction model comprises a historical model that correlates the lab measurements of the existing drill cuttings, and the historical drilling surface data from the plurality wells, by employing a machine-learning algorithm.

According to one aspect, embodiments disclosed herein relate to s non-transitory computer readable medium storing instructions. The instructions obtain lab measurements of existing drill cuttings at a plurality of depths of a first well. The instructions obtain historical drilling surface data at the plurality of depths from a plurality of wells. The instructions obtain real-time digital photos and real-time drilling surface data of new drill cuttings at a new depth of a new well. The instructions generate, using a prediction model, predicted formation properties of the new drill cuttings based on the real-time digital photos, the real-time drilling surface data, and the new depth. The instructions further predict, using a near-real-time model and the predicted formation properties, near-real-time formation properties in the new well, wherein the prediction model comprises a historical model that correlates the lab measurements of the existing drill cuttings and the historical drilling surface data from the plurality of wells, by employing a machine-learning algorithm.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
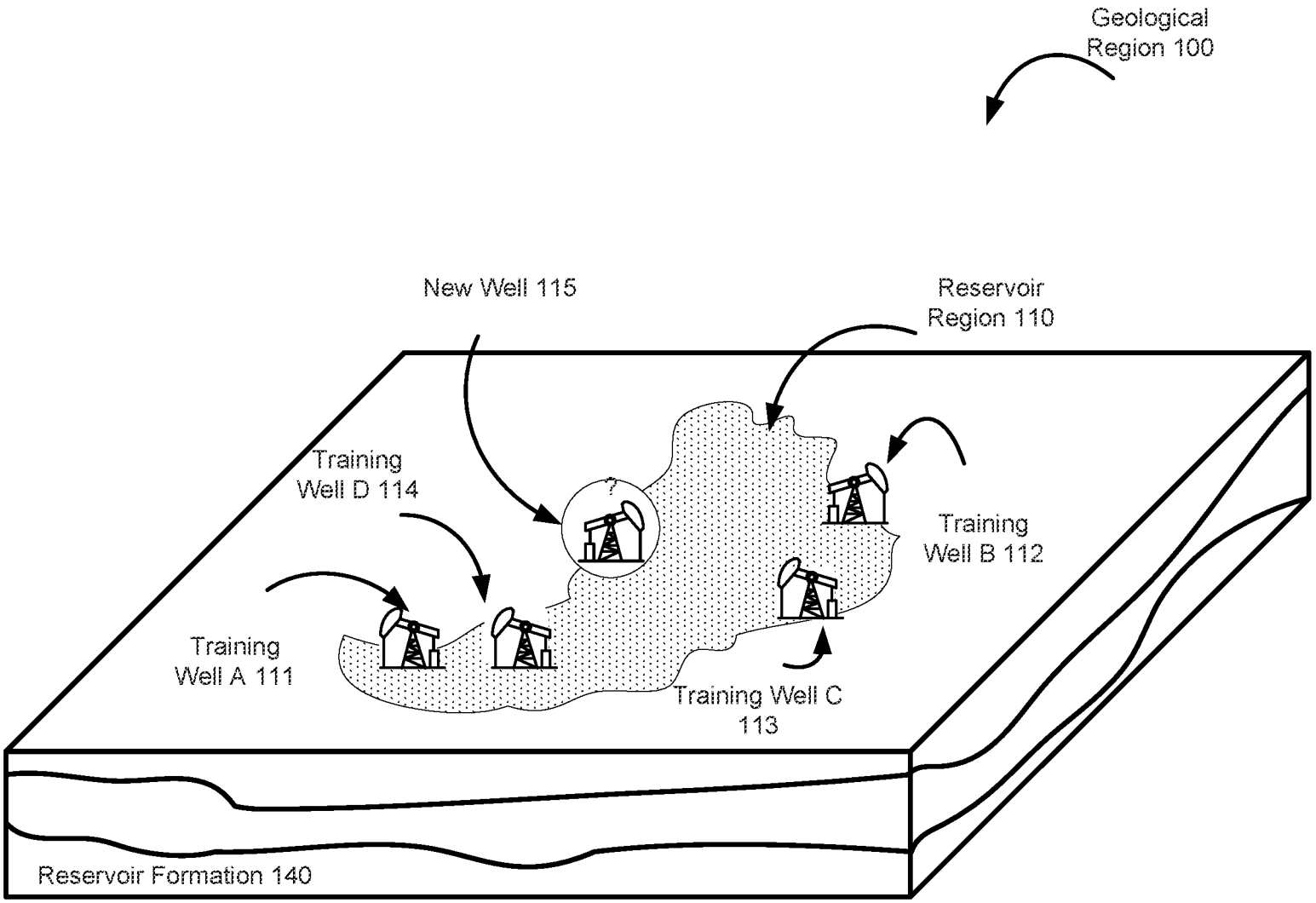
FIG. 1 shows a system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a system and a method for formation properties prediction in near-real time. More specifically, the present disclosure relates to methods for automated analysis of drill cuttings received at the surface from a well bore, analyzing drilling surface data, utilizing historical drilling and laboratory data, and predicting formation in near real-time by using drill cuttings images. In some embodiments, the method may utilize training data from existing wells to generate a historical model. Further, the method may utilize a prediction model including outputs of the historical model and real-time data from a new well to generate predicted formation properties for the new well.

Furthermore, the method may utilize a near-real-time model and the predicted formation properties to predict near-real-time formation properties ahead of the drill bit in the new well. In some embodiments, the historical model may utilize machine learning (ML) algorithms. Accordingly, timely analysis and prediction of the formation properties of the new well is achieved, human errors are avoided and/or reduced, and historical data and behaviors may be fully utilized.

FIG. 1 shows a schematic diagram in accordance with one or more embodiments. As illustrated in FIG. 1, FIG. 1 shows a geological region (e.g., geological region (100)) that may include one or more reservoir regions (e.g., reservoir region (110)) with a plurality of training wells (e.g., training well A (111), training well B (112), training well C (113), and training well D (114)) and a new well (e.g., new well (115)). As shown in FIG. 1, the training wells (111, 112, 113, 114) and the new well (115) are disposed above a reservoir formation (e.g., reservoir formation (140)). In alternate embodiments, the new well (115) and the training wells (111, 112, 113, 114) may not necessarily belong to a same reservoir region, and thus, may not be adjacent wells in the same geological region, but may be distant from each other and part of different geological regions.

Figure 2:
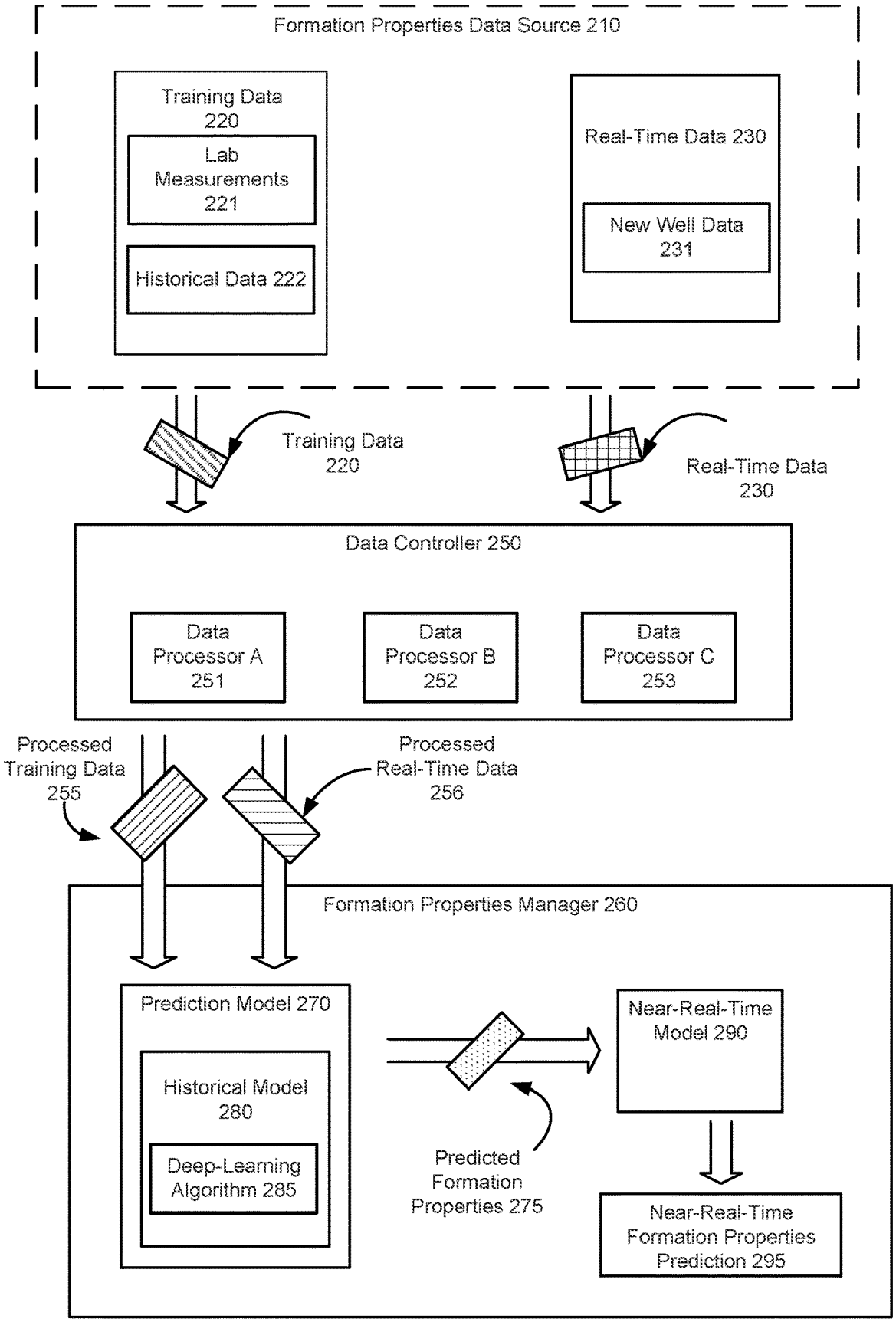
FIG. 2 shows a system in accordance with one or more embodiments.

Turning to FIG. 2, FIG. 2 shows a block diagram of a system in accordance with one or more embodiments. As shown in FIG. 2, a formation properties data source (e.g., formation properties data source (210)) provides various data for a data controller (e.g., data controller (250)) and a formation properties manager (e.g., formation properties manager (260)). A data source may refer to any location where data that is being used originates or is stored. More specifically, a data source may be a database located in a disk or a remote server, live measurements from physical devices, or a(n) file/data sheet/XML file within a computer program, etc. Types of data sources may differ according to the purposes or functions of an application. In one or more embodiments, the formation properties data source may be stored on a computer. The formation properties data source (210) may include training data (e.g., training data (220)) and real-time data (e.g., real-time data (230)). In some embodiments, the training data (220) may be collected from one or more of the various training wells (111, 112, 113, 114) of the reservoir formation (140) at various depths, and the real-time data (230) may be collected from the new well (121) of the reservoir formation (140) at a new depth.

In one or more embodiments, the training data (220) may include lab measurements (e.g., lab measurements (221)) and historical data (e.g., historical data (222)). Detailed contents of the lab measurements (221) and the historical data (222) will be further explained below.

Specifically, the lab measurements (221) may refer to mineralogy data, lithology data, and digital photos of existing drill cuttings collected from at least one of the training wells (111, 112, 113, 114) at various depths. In some embodiments, drill cuttings may refer to broken bits of solid material removed from a drilled borehole. The drill cuttings are carried to the surface of a well by circulating up drilling fluid, and can be separated from the drilling fluid by shale shakers. Mineralogy data specifies scientific study related to a mineral, including chemistry properties, crystal structure, and physical properties. Lithology data specifies physical characteristics of a rock, including color, texture, grains size, grain shape, and composition. The digital photos of the existing drill cuttings may be images captured and produced by cameras containing arrays of electronic photodetectors. The digital photos are digitalized images and are stored as computer files ready for further digital processing and viewing.

Further, the historical data (222) may refer to drilling surface data collected from at least one of the training wells (111, 112, 113, 114) at the various depths. In particular, in some embodiments, the drilling surface data may include rate of penetration (ROP), weight on bit (WOB), SPP (standpipe pressure), logging-while-drilling (LWD), and hookload.

More specifically, the ROP refers to the speed at which a drill bit breaks the rock under it to deepen a borehole. While drilling, the ROP increases in fast drilling formations and decreases in slow drilling formations. The ROP can be expressed as either distance drilled per unit of time (e.g., feet per hour) or time per distance drilled (e.g., minutes per foot). The WOB refers to the amount of downward force exerted on a drill bit during drilling operations. The WOB is usually measured in thousands of pounds and is provided by thick-walled drilled collars. The WOB provides force for the drill bit in order to effectively break the rock.

Continuing with the historical data (222), the SPP refers to the total pressure loss in a system that occurs due to fluid friction. The SPP is a summation of pressure loss in annulus, pressure loss in drill string, pressure loss in bottom hole assembly (BHA), and pressure loss across the bit. The SPP is highly related to jet bit nozzle size selection and flow rate of the cleaning fluid determination, in order to ensure efficient cleaning of the drilled borehole and proper selection of mud pump liner. The LWD refers to measurement of formation properties during the excavation of or shortly after the borehole, through tools integrated into the BHA. The LWD has the advantage of measuring properties of a formation before drilling fluids invade deeply, and timely LWD data can be used to guide well placement, particularly in the zone of interests or in the most productive portion of the formation reservoir. Hookload refers to the actual weight of the drill string measured from the surface. Knowing the hookload helps a drilling person to control weight on bit and decide to increase or decrease the weight imposed on the drill bit.

In some embodiments, the real-time data (230) may include new well data (e.g., new well data (231)). The new well data (231) may refer to real-time drilling surface data and real-time digital photos of new drill cuttings collected from the new well (121) at one or more new/different depths, as well as the actual depth at the time when these data are collected.

The drilling surface data of the new drill cuttings from the new well may also include real-time collected ROP, WOB, SPP, LWD, and hookload as described above.

Keeping with FIG. 2, the data controller (250) may be software and/or hardware implemented on any suitable computing device, and may include functionalities for collecting various data from the formation properties data source (210) and processing the collected data. For example, the data controller (250) may collect the training data (220) in different formats from the formation properties data source (210). The data controller may include data processors (e.g., data processor A (251), data processor B (252), and data processor C (253)) that further convert the collected training data to unified formats. For example, formats of the digital photos comprised in the lab measurements (221) may be, but not limited to, at least one of tif., tiff., gif., png., eps., and raw. In addition, formats of the drilling surface data comprised in the historical data (222) may be, but not limited to, at least one of .las files, txt files, and .xlsx files. Each of the data processors (251, 252, 253) has a functionality to convert a type of data in different formats into a single format. For example, the data processor A (251) may include functionality to convert formats of the collected digital photos of the existing drill cuttings from the training well A (111) into a format of png.; and the data processor B (252) may include functionality to convert formats of the collected drilling surface data of the training wells (111, 112, 113, 114) into a format of .txt.

Continuing with the data controller (250), in addition to collecting and processing the training data (220), the real-time data (230) in different formats may be collected and processed in a similar fashion by the data controller (250) and the data processors (251, 252, 253).

In one or more embodiments, the data controller (250) may be coupled with the formation properties manager (260). In some embodiments, the formation properties manager (260) may be software and/or hardware implemented on the same or a different computing device as the data controller, and may include functionality for detecting and/or managing formation properties. For example, the formation properties manager (260) may collect processed training data (e.g., processed training data (255)) and processed real-time data (e.g., processed real-time data (256)) from the coupled data controller (250). Further, the formation properties manager (260) may include functionality to generate a historical model (e.g., historical model (280)) by utilizing the processed training data (255) from the data controller (250) and applying a machine-learning algorithm that will be explained below.

In one or more embodiments, the formation properties manager (260) may include a prediction model (e.g., prediction model (270)) that generates predicted formation properties (e.g., predicted formation properties (275)) of the new well based on the collected real-time data (230) of the new well. Moreover, the formation properties manager (260) may include a near-real-time model (e.g., near-real-time model (290)). The near-real-time model (290) may be one or more trained machine learning model that includes functionality to predict formation properties in near-real-time (e.g., near-real-time formation properties prediction (295)) ahead of the drill bit.

In some embodiments, the formation properties data source (210), the data controller (250), and the formation properties manger (260) may be implemented on the same computing device, or different computing systems connected by a network. In some embodiments, the formation properties data source (210), the data controller (250), the formation properties manager (260), and/or other elements, including but not limited to network elements, user equipment, user devices, servers, and/or network storage devices may be implemented on computing systems similar to the computing system (500) shown and described in FIG. 5 below.

Continuing with FIG. 2, in one or more embodiments, the prediction model (270) may include the historical model (280). The historical model (280) may be one or more trained machine learning models trained based on the training data (220) that collects the processed training data (255), and correlates parameters of the lab measurement (221) and the historical data (222), which are represented by the processed training data (255). In some embodiments, the trained machine learning models adopted by the historical model (280) may be trained using a deep-learning algorithm (e.g., deep-learning algorithm (285)). Those skilled in the art will appreciate that the prediction model (270) uses the output of the historical model (280), which may also be a machine learning model itself, to predict properties on new data. Further, while embodiments of FIG. 2 show the historical model as being part of the prediction model, those skilled in the art will appreciate that the models may be separate and operatively connected via a network, such as the Internet.

Figure 3:
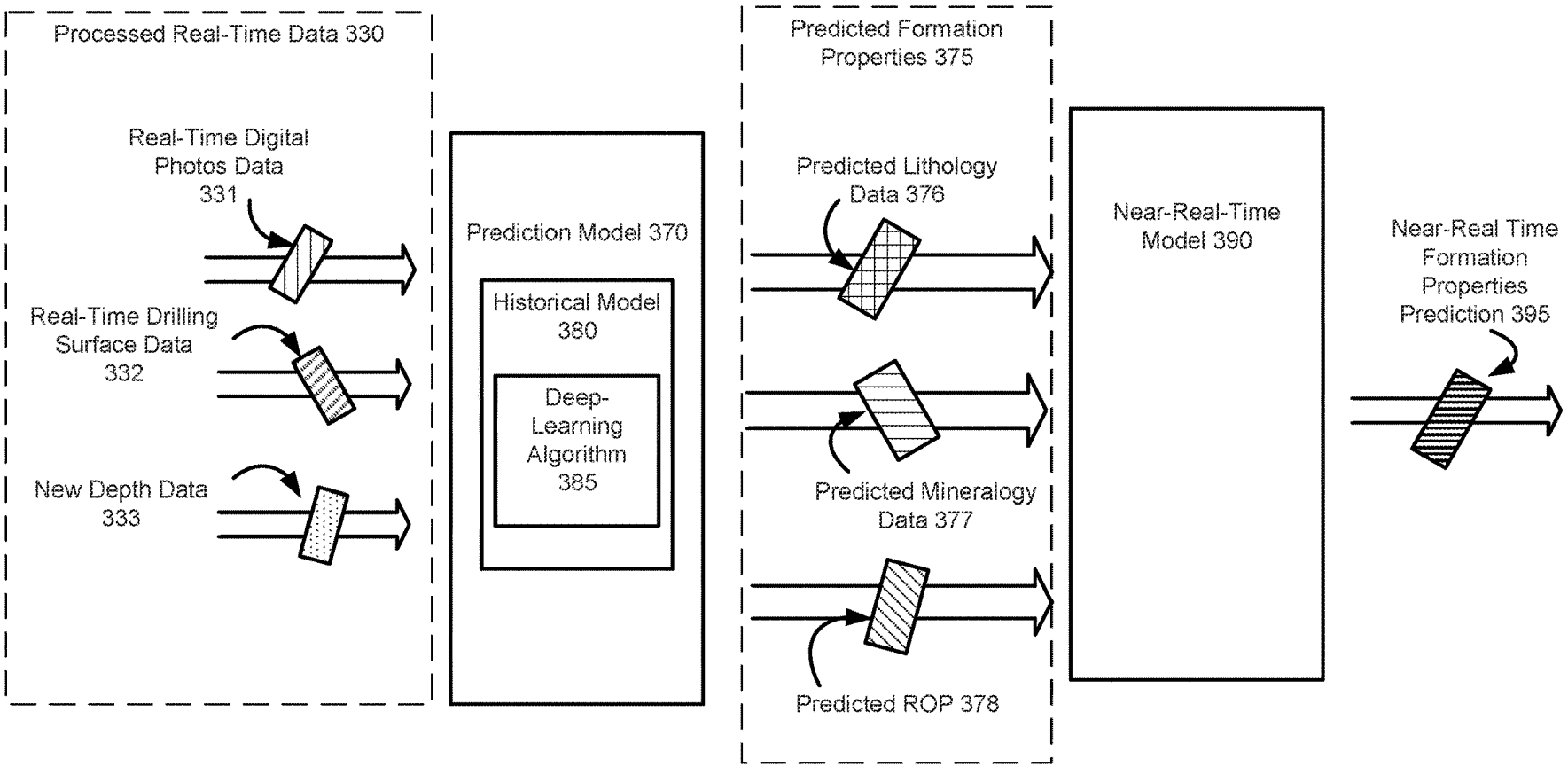
FIG. 3 shows an example in accordance with one or more embodiments.

Turning to FIG. 3, FIG. 3 provides an example of generating a series of models in order to predict near-real time formation properties of a formation being drilled in real-time. The following example is for explanatory purposes only and not intended to limit the scope of the disclosed technology. In FIG. 3, a learned historical model (e.g., historical model (380)) may be one or more machine learning models trained by using a deep-learning algorithm (e.g., deep-learning algorithm (385)). In particular, similar to the description in FIG. 2, the learned historical model (380) may obtain a plurality of processed training data as inputs for training. Using the inputs, the learned historical model (380) outputs correlations between digital photos of drill cuttings, drilling surface data, and depths at where the drill cuttings and the drilling surface data are obtained.

Machine learning models include supervised machine learning models and unsupervised machine learning models. More specifically, supervised machine learning models include classification, regression models, etc. Unsupervised machine learning models include, for example, clustering models. Deep-learning algorithms are a part of machine learning methods based on artificial neural networks with representation learning. For example, a deep-learning algorithm may run data through multiple layers of neural network algorithms, each of which passes a simplified representation of the data to the next layer. More specifically, each artificial neural network consists a plurality of neurons that are staked next to each other and organized in layers. Each neuron may receive various inputs, multiplies the inputs by weights, sums them up, and applies a non-linear function. Deep-learning algorithms are particularly used when a large number of parameters are involved and require access to a vast amount of data to be effective, for example, images process involving millions of features. In one or more embodiments, the deep-learning algorithm (385) may utilize one or more neural network architectures, such as but not limited to, convolutional neural networks, recurrent neural networks, general adversarial neural networks, deep belief networks, autoencoders, etc.

Further, a prediction model (e.g., prediction model (370)) that utilizes the output of the historical model (380) obtains a plurality of processed real-time data (e.g., processed real-time data (330)) of a new well as inputs. In particular, the processed real-time data (330) may include data representing real-time digital photos (e.g., real-time digital photos data (331)), data representing real-time drilling surface data (e.g., real-time drilling surface data (332)), and data representing new depth (e.g., new depth data (333)) at where the aforementioned data are collected. Based on these inputs and the historical model (380), the prediction model (370) outputs predicted lithology data (e.g., predicted lithology data (376)) and predicted mineralogy data (e.g., predicted mineralogy data (377)) in real-time in the borehole being drilled, and predicted ROP (e.g., predicted ROP (378)) of the drill bit in real-time. Predicted lithology data (376) may include formation grain size and shape, as well as mineralogy content, color, and oil shows.

Keeping with FIG. 3, a near-real-time model (e.g., near-real-time model (390)) obtains the outputs of the prediction model (e.g., prediction formation properties (375)) as inputs. The near-real-time model may be one or more machine learning models that further predict formation properties at a near-real-time (e.g., near-real-time formation properties prediction (395)). Specifically, during the drilling operation, the drill bit continuously moves downward or forward along the borehole well. As such, while the prediction model (370) predicts the formation properties (375) based on the real-time data (330), the drill bit would have moved away from the location at where the real-time data (330) were collected. Therefore, the near-real-time model (390) is required to utilize the predicted formation properties (375) to further predict the near-real-time formation properties (395) ahead of the drill bit at the current moment.

In addition, similar to the trained historical model (380), the near-real-time model (390) may be one or more machine learning models that employ the deep-learning algorithms as described above.

While FIG. 3 shows various configurations of components, other configurations may be used without departing from the scope of the disclosure. For example, various components in FIG. 3 may be combined to create a single component. As another example, the functionality performed by a single component may be performed by two or more components.

Figure 4:
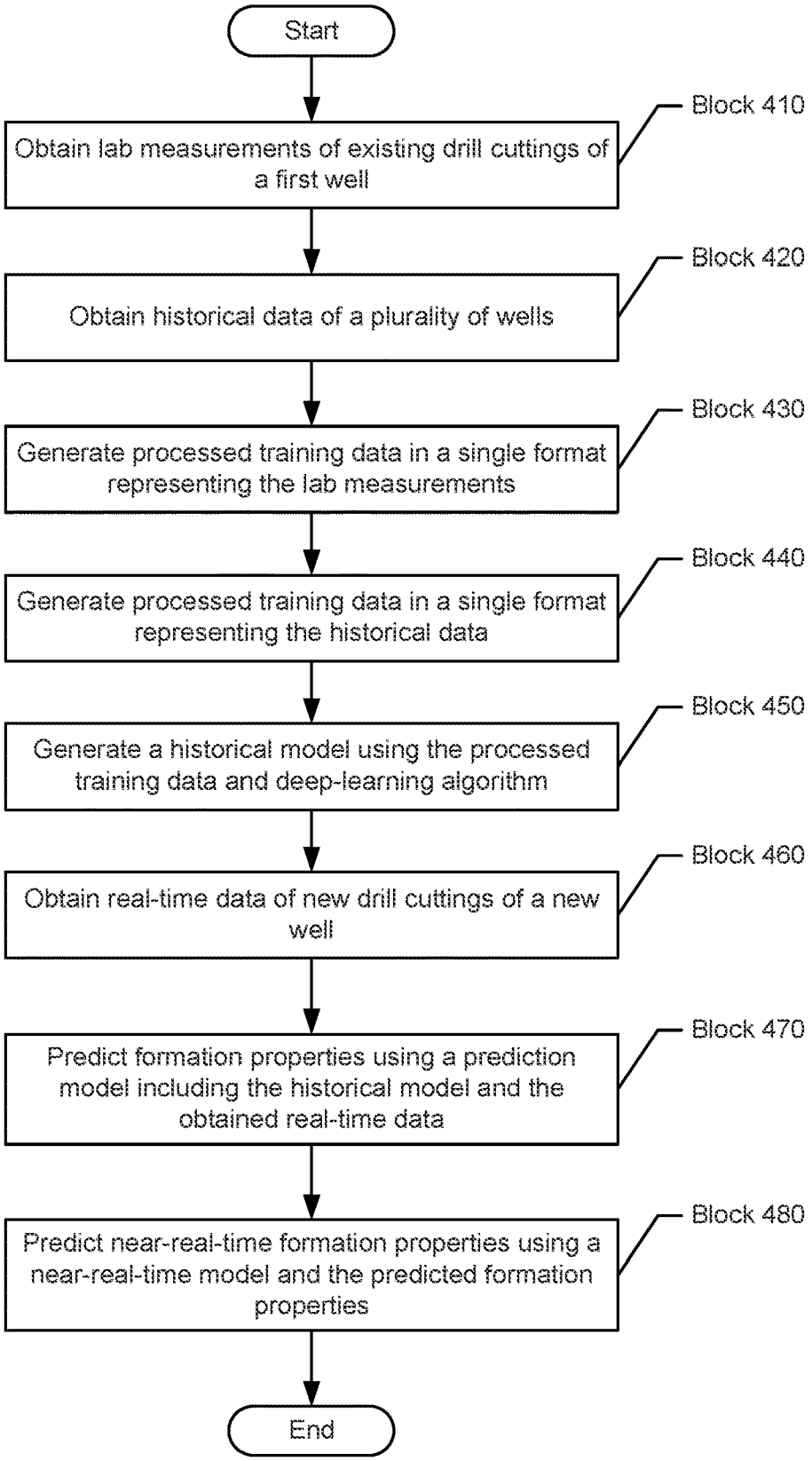
FIG. 4 shows a flowchart in accordance with one or more embodiments.

Turning to FIG. 4, FIG. 4 shows a flowchart in accordance with one or more embodiments. Specifically, FIG. 4 describes a general method for predicting formation properties in near-real-time. One or more blocks in FIG. 4 may be performed by one or more components as described in FIG. 2, for example, the formation properties manager (260). While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 410, lab measurements of existing drill cuttings are obtained. For example, lab measurements including lithology data, minerology data, and digital photos of existing drill cutting are collected from a plurality of depths of a training well. The lab measurements may be obtained by a data controller.

In Block 420, historical data of a plurality of training wells are obtained. For example, historical data including drilling surface data at the plurality of depths among the plurality of the training wells. In particular, the drilling surface data may include ROP, WOB, SPP, and LWD at the plurality of depths. The historical data may be obtained by the data controller.

In Block 430, the lab measurements are pre-processed in a single format. For example, the digital photos included in the lab measurements may in various formats, and a data processor comprised in the data controller may process the obtained digital photos and convert them in a single format. The obtained lithology data and minerology data may be processed in a similar manner.

In Block 440, the historical data are pre-processed in a single format. For example, the various drilling surface data may in different formats, and another data processor comprised in the data controller may process the drilling surface data so that file formats of these data are unified. The formats of the lab measurements and the historical data may or may not be the same after the preprocessing occurs in Blocks 430 and 440.

In Block 450, a historical model is generated. In particular, the historical model is generated utilizing the processed lab measurements and the processed historical data, and by employing a deep-learning algorithm, or any other suitable machine learning algorithm. For example, the historical model applies the deep-learning algorithm to correlate the parameters of the lab measurements and the historical data to each other. As a result, the historical model may generate corresponding outputs when new parameters are entered, wherein the new parameters and the corresponding outputs are within the scope of the lab measurements and the historical data.

In Block 460, real-time data of new drill cuttings of a new well are obtained. In particular, the real-time data may include digital photos of the new drill cuttings at a new depth, drilling surface data of the new well at the new depth, and the new depth. The real-time data reflect parameters of the new well at the new depth and at the time when the real-time data are collected.

In Block 470, formation properties of the new well are predicted. For example, the obtained real-time data from Block 460 are entered into a prediction model including the historical model, and the prediction model predicts formation properties of the new well at the new depth and at the time when the real-time data are collected. However, during the procedure of Blocks 460 and 470, the drill bit continuously moves along a borehole. As such, when the predicted formation properties are outputted by the prediction model, the predicted formation properties may be same as or different from the formation properties at the latest location of the drill bit.

In Block 480, near-real-time formation properties are predicted. For example, the predicted formation properties from Block 470 are entered in a near-real-time model that further predicts the near-real-time formation properties of the new well ahead of the drill bit. As a result, the near-real-time formation properties that more accurately reflect the formation properties of the new well at a depth ahead of the drill bit at the current moment are achieved. In particular, the near-real-time formation may be a machine-learning model. The process ends after Block 480

Those skilled in the art will appreciate that the process of FIG. 4 may be repeated for any new well that is to be drilled in a reservoir region.

Figure 5:
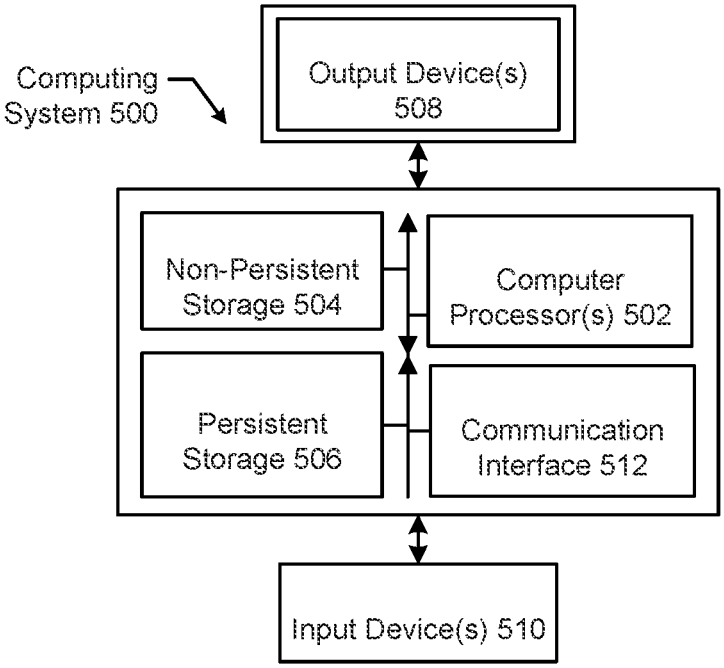
FIG. 5 shows a computer system in accordance with one or more embodiments.

FIG. 5 shows a computing system in accordance with one or more embodiments. Embodiments disclosed herein may be implemented on a computing system. Any combination of mobile, desktop, server, router, switch, embedded device, or other types of hardware may be used. For example, as shown in FIG. 5, the computing system (500) may include one or more computer processors (502), non-persistent storage (504) (e.g., volatile memory, such as random access memory (RAM), cache memory), persistent storage (506) (e.g., a hard disk, an optical drive such as a compact disk (CD) drive or digital versatile disk (DVD) drive, a flash memory, etc.), a communication interface (512) (e.g., Bluetooth interface, infrared interface, network interface, optical interface, etc.), and numerous other elements and functionalities.

The computer processor(s) (502) may be an integrated circuit for processing instructions. For example, the computer processor(s) may be one or more cores or micro-cores of a processor. The computing system (500) may also include one or more input devices (510), such as a touchscreen, keyboard, mouse, microphone, touchpad, electronic pen, or any other type of input device. In one or more embodiments, the computer processor(s) (502) may be included in the formation properties manager (260) as described in FIG. 2 and the accompanying description.

The communication interface (512) may include an integrated circuit for connecting the computing system (500) to a network (not shown) (e.g., a local area network (LAN), a wide area network (WAN) such as the Internet, mobile network, or any other type of network) and/or to another device, such as another computing device.

Further, the computing system (500) may include one or more output devices (508), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (502), non-persistent storage (504), and persistent storage (506). Many different types of computing systems exist, and the aforementioned input and output device(s) may take other forms. In one or more embodiments, the one or more output devices (508) may be included in the formation properties manager (260) in order to output the near-real-time formation properties prediction (295) as described in FIG. 2 and the accompanying description.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

The computing system (500) in FIG. 5 may be connected to or comprise a computer that further comprises the formation properties data source (210), the data controller (250), and the formation properties manager (260) as described in FIG. 2 and the accompanying description.

The computing system of FIG. 5 may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The above description of functions presents only a few examples of functions performed by the computing system of FIG. 5. Other functions may be performed using one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method, comprising: obtaining, by a computer processor, lab measurements of existing drill cuttings at a plurality of depths of a first well; obtaining, by the computer processor, historical drilling surface data at the plurality of depths from a plurality of wells; obtaining, by the computer processor, real-time digital photos and real-time drilling surface data of new drill cuttings at a new depth of a new well; generating, by the computer processor using a prediction model, predicted formation properties of the new drill cuttings based on the real-time digital photos, the real-time drilling surface data, and the new depth; and predicting, by the computer processor using a near-real-time model and the predicted formation properties, near-real-time formation properties in the new well, wherein the prediction model comprises a historical model that correlates the lab measurements of the existing drill cuttings, and the historical drilling surface data from the plurality of wells, by employing a machine-learning algorithm, wherein the predicted formation properties of the new drill cuttings comprise predicted lithology data including at least a formation grain size and a shape, predicted mineralogy data including at least a color and oil shows, and predicted rate of penetration (ROP), and wherein the lab measurements comprise lithology data, mineralogy, and digital photos of the existing drill cuttings obtained at various depths.

2. The method of claim 1, wherein the machine-learning algorithm is a deep learning algorithm that uses the lab measurements and the historical drilling surface data from the plurality of wells as inputs to a learned deep learning model.

3. The method of claim 1, wherein the near-real-time model is a model that employs a machine-learning algorithm and uses the predicted formation properties from the prediction model as inputs.

4. The method of claim 1, further comprising:

generating a first set of processed data in a single format representing the lab measurements of the existing drill cuttings; and generating a second set of processed data in a single format representing the historical drilling surface data from the plurality of wells.

5. The method of claim 1, wherein the historical drilling surface data comprise rate of penetration (ROP), weight on bit (WOB), stand pipe pressure (SPP), logging-while-drilling (MD) data, and hookload.

6. A system, comprising: a plurality of formation properties data; and a formation properties manager comprising a computer processor, wherein the formation properties manager is configured to: obtain lab measurements of existing drill cuttings at a plurality of depths of a first well; obtain historical drilling surface data at the plurality of depths from a plurality of wells; obtain real-time digital photos and real-time drilling surface data of new drill cuttings at a new depth of a new well; generate, using a prediction model, predicted formation properties of the new drill cuttings based on the real-time digital photos, the real-time drilling surface data, and the new depth; and predict, using a near-real-time model and the predicted formation properties, near-real- time formation properties in the new well, wherein the prediction model comprises a historical model that correlates the lab measurements of the existing drill cuttings, and the historical drilling surface data from the plurality wells, by employing a machine-learning algorithm, wherein the predicted formation properties of the new drill cuttings comprise predicted lithology data including at least a formation grain size and a shape, predicted mineralogy data including at least a color and oil shows, and predicted rate of penetration (ROP), and wherein the lab measurements comprise lithology data, mineralogy, and digital photos of the existing drill cuttings obtained at various depths.

7. The system of claim 6, wherein the machine-learning algorithm is a deep learning algorithm that uses the lab measurements of the existing drill cuttings, and the historical drilling surface data from the plurality wells as inputs to a learned deep learning model.

8. The system of claim 6, wherein the near-real-time model is a model that employs a machine-learning algorithm and uses the predicted formation properties from the prediction model as inputs.

9. The system of claim 6, the formation properties manager is further configured to:

generate a first set of processed data in a single format representing the lab measurements of the existing drill cuttings; and generate a second set of processed data in a single format representing the historical drilling surface data from the plurality wells.

10. The system of claim 6, wherein the drilling surface data from the plurality of wells comprise rate of penetration (ROP), weight on bit (WOB), stand pipe pressure (SPP), logging-while-drilling (LWD) data, and hookload.

11. A non-transitory computer readable medium storing instructions executable by a computer processor, the instructions comprising functionality for: obtaining lab measurements of existing drill cuttings at a plurality of depths of a first well; obtaining historical drilling surface data at the plurality of depths from a plurality of wells; obtaining real-time digital photos and real-time drilling surface data of new drill cuttings at a new depth of a new well; generating, using a prediction model, predicted formation properties of the new drill cuttings based on the real-time digital photos, the real-time drilling surface data, and the new depth; and predicting, using a near-real-time model and the predicted formation properties, near-real-time formation properties in the new well, wherein the prediction model comprises a historical model that correlates the lab measurements of the existing drill cuttings and the historical drilling surface data from the plurality of wells, by employing a machine-learning algorithm, wherein the predicted formation properties of the new drill cuttings comprise predicted lithology data including at least a formation grain size and a shape, predicted mineralogy data including at least a color and oil shows, and predicted rate of penetration (ROP), and wherein the lab measurements comprise lithology data, mineralogy, and digital photos of the existing drill cuttings obtained from various depths.

12. The non-transitory computer readable medium of claim 11, wherein the machine-learning algorithm is a deep learning algorithm that uses the lab measurements of the existing drill cuttings and the historical drilling surface data from the plurality of wells as inputs to a learned deep learning model.

13. The non-transitory computer readable medium of claim 11, wherein the near-real-time model is a model that employs a machine-learning algorithm and uses the predicted formation properties from the prediction model as inputs.

14. The non-transitory computer readable medium of claim 11, wherein the instructions further comprising functionality for:

generating a first set of processed data in a single format representing the lab measurements of the existing drill cuttings; and generating a second set of processed data in a single format representing the historical drilling surface data from the plurality of wells.

15. The non-transitory computer readable medium of claim 11, wherein the drilling surface data from the plurality of wells comprises rate of penetration (ROP), weight on hit (WOB), stand pipe pressure (SPP), (LWD) data, and hook-load.

* * * * *